US011235340B2

(12) United States Patent
Kiefer

(10) Patent No.: US 11,235,340 B2
(45) Date of Patent: Feb. 1, 2022

(54) SANITARY OUTLET UNIT

(71) Applicant: Neoperl GmbH, Mullheim (DE)

(72) Inventor: Thomas Kiefer, Neuenburg (DE)

(73) Assignee: NEOPERL GMBH, Mullheim (DE)

( * ) Notice: Subject to any disclaimer, the term of this patent is extended or adjusted under 35 U.S.C. 154(b) by 0 days.

(21) Appl. No.: 15/781,910

(22) PCT Filed: Dec. 13, 2016

(86) PCT No.: PCT/EP2016/002100
§ 371 (c)(1),
(2) Date: Jun. 6, 2018

(87) PCT Pub. No.: WO2017/108167
PCT Pub. Date: Jun. 29, 2017

(65) Prior Publication Data

US 2018/0353979 A1 Dec. 13, 2018

(30) Foreign Application Priority Data

Dec. 23, 2015 (DE) ..... 202015008802.3

(51) Int. Cl.
*B05B 1/18* (2006.01)
*E03C 1/08* (2006.01)
*B05B 1/34* (2006.01)

(52) U.S. Cl.
CPC ..... *B05B 1/185* (2013.01); *B05B 1/3405* (2013.01); *E03C 1/08* (2013.01)

(58) Field of Classification Search
CPC ..... B05B 1/185; B05B 1/3405; E03C 1/08; E03C 1/0404; E03C 1/0405; E03C 1/084
USPC ..... 239/492–497
See application file for complete search history.

(56) References Cited

U.S. PATENT DOCUMENTS

| | | | | |
|---|---|---|---|---|
| 4,765,540 | A * | 8/1988 | Yie | B05B 7/1486 239/396 |
| 6,775,865 | B1 | 8/2004 | Lin | |
| 2005/0246832 | A1 | 11/2005 | Zoller et al. | |
| 2006/0032945 | A1 | 2/2006 | Clearman et al. | |
| 2012/0325933 | A1 | 12/2012 | Blum | |
| 2014/0217203 | A1* | 8/2014 | Zoller | E03C 1/084 239/428.5 |
| 2017/0173601 | A1* | 6/2017 | Mazz | B05B 1/16 |

FOREIGN PATENT DOCUMENTS

| | | |
|---|---|---|
| CN | 201809818 | 4/2011 |
| DE | 4108521 | 9/1992 |
| DE | 202004007352 | 9/2005 |
| DE | 102004022513 | 12/2005 |
| DE | 102008015968 | 9/2009 |
| DE | 102008015970 | 9/2009 |
| WO | 2013077030 | 5/2013 |

* cited by examiner

*Primary Examiner* — Tuongminh N Pham
(74) *Attorney, Agent, or Firm* — Volpe Koenig

(57) ABSTRACT

In the case of a sanitary outlet unit (1, 10), it is therefore provided to form throughflow channels (4) in a jet former (3) in such a manner that an outflow direction (14) predetermined by each throughflow channel (4) is oriented in a manner tilted in relation to a longitudinal housing axis (12) in two planes perpendicular to each other and/or about two directions perpendicular to each other.

8 Claims, 10 Drawing Sheets

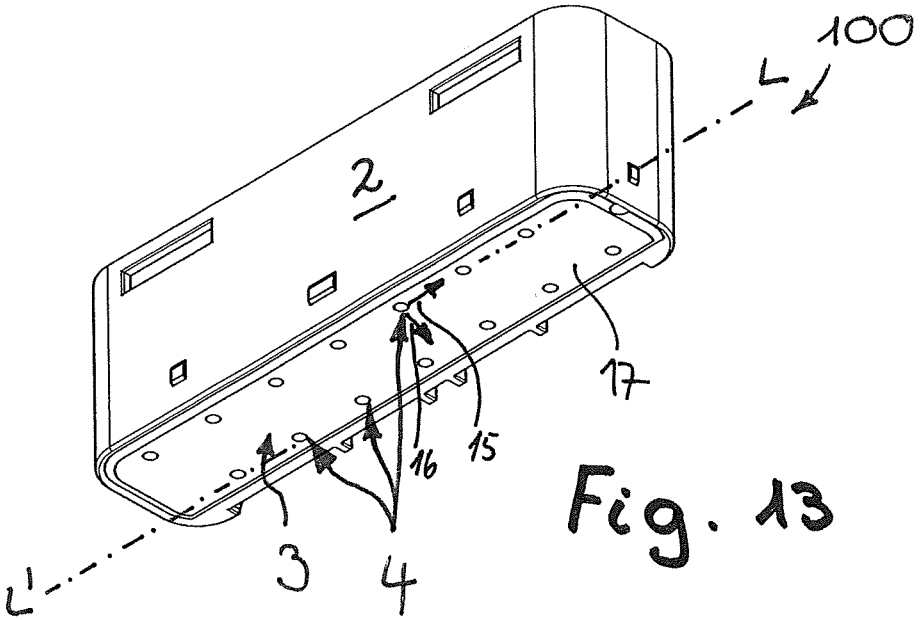
Fig. 13
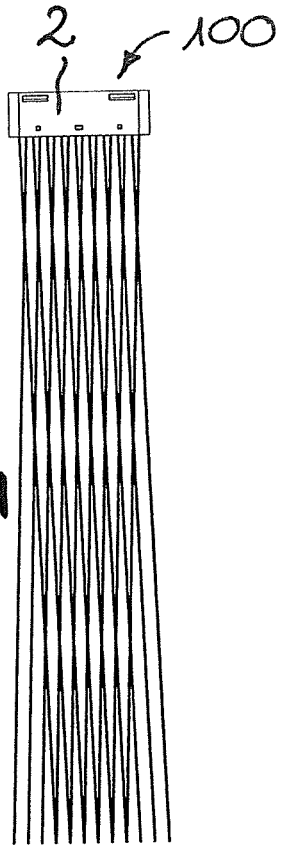
Fig. 14
Fig. 15
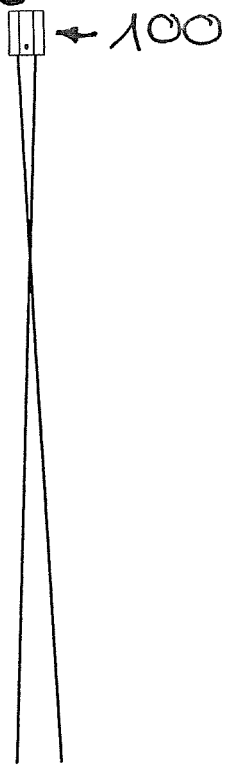
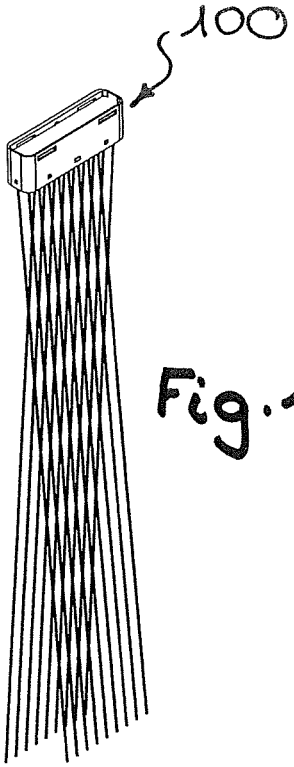
Fig. 16

SANITARY OUTLET UNIT

BACKGROUND

The invention relates to a sanitary outlet unit which has a housing which can be installed on the water outlet of a sanitary outlet fitting and, on its outlet end side, has a jet former, which has throughflow channels which are arranged on the outlet end side of the housing and by means of which the water flowing out of the jet former is divided up into separated, individual jets.

The sanitary outlet units of the type mentioned at the beginning have previously been known, for example, in the form of what are referred to as spray jet regulators. Such spray jet regulators typically have a housing which can be installed on the water outlet of a sanitary outlet fitting. The housing of said previously known spray jet regulator has, on its outlet end side, a jet former, which has throughflow channels which are arranged on at least one circular path on the outlet end side. With the aid of said throughflow channels, the water emerging from the jet former is divided up into separated, individual jets such that a spray jet formed from visibly separated individual jets emerges.

DE 41 08 521 A1 discloses a jet-type shower with a shower head which, in order to form a shower jet, has a multiplicity of water outlet openings which are guided in a manner positioned radially outward and lying in an axial plane. A soft shower jet is intended to be produced by a flow deflection of the water flowing through the housing of the previously known jet-type shower.

An effort is made nowadays to provide sanitary outlet fittings with an esthetically attractive form going beyond the intended purpose. Possibilities are being searched for time and again also to configure the water jet emerging from the outlet fitting, for example in the form of a stream of water, to be esthetically attractive.

SUMMARY

It is therefore the object to provide a sanitary outlet unit of the type mentioned at the beginning which is distinguished by an esthetically particularly attractive outlet jet pattern.

In order to achieve the object mentioned, a sanitary outlet unit having one or more features according to the invention is provided. In particular, in order to achieve the object mentioned, in the case of a sanitary outlet unit of the type described at the beginning, it is therefore provided according to the invention that, for this purpose, the throughflow channels, which are arranged on at least one closed path, each define an outflow direction, which is produced by rotation from a longitudinal housing axis both in a plane defined by a longitudinal housing axis and a tangential direction to the closed path and in a plane defined by the longitudinal housing axis and a complementary direction, which is perpendicular to the longitudinal housing axis and the tangential direction. It is therefore possible to produce an outlet jet pattern which, firstly, for example by the rotation mentioned first, appears to have a swirl and, secondly, for example by the rotation mentioned at a second point, takes on an outer contour differing from a cylindrical shape. The outflow direction is therefore tilted out of the two planes mentioned.

In particular, in order to achieve the object mentioned, in the case of a sanitary outlet unit of the type described at the beginning, it is therefore alternatively or additionally provided according to the invention that the throughflow channels, which are arranged on at least one closed path, each define an outflow direction, which encloses an angle with a longitudinal housing axis both in a projection onto a plane defined by the longitudinal housing axis and a tangential direction to the closed path and in a projection onto a plane defined by the longitudinal housing axis and a complementary direction, which is perpendicular to the longitudinal housing axis and the tangential direction. It is therefore possible to produce an outlet jet pattern which, firstly, for example by the angle mentioned first, appears to have an intertwining of jets which are intertwined in a viewing position situated laterally with respect to the outflow direction and, secondly, for example by the angle mentioned at a second point, adopts an outer contour differing from a constant cross section.

In a refinement of the invention, it can be provided that the outflow directions are provided by a longitudinal axis of the respective throughflow channel. The outflow direction can therefore be simply oriented by a shaping of the associated throughflow channel.

In a refinement of the invention, it can be provided that the outflow directions of the throughflow channels each enclose with the tangential direction an angle which is located in the same quadrant for all the throughflow channels. A uniform swirl and/or a uniform intertwining of the jets of the outlet jet pattern can therefore be achieved irrespective of a viewer's position. The angles are preferably in each case selected to be equal to one another.

In a refinement of the invention, it can alternatively or additionally be provided that the outflow directions of the throughflow channels each enclose with the complementary direction an angle which is located in the same quadrant for all the throughflow channels. A uniform opening or constriction of the outlet jet pattern can therefore be achieved from all lateral viewer positions. The angles are preferably in each case selected to be equal to one another.

In a refinement of the invention, it can be provided that the outflow directions are inclined into an inner space delimited from the closed path. A tapered or conically tapering outer contour of the outlet jet pattern can therefore be achieved.

In a refinement of the invention, it can be provided that the closed path is an annular or circular path. The invention can therefore be used in the case of outlet units having a round outer contour or round cross section.

An inventive proposal for achieving this object in the case of the sanitary outlet unit of the type mentioned at the beginning therefore consists in particular in that the throughflow channels arranged on at least one annular or circular path have a longitudinal axis which is inclined both in the direction of the longitudinal housing axis and in a circumferential direction.

The outlet unit according to the invention which is formed in accordance with this inventive proposal has a housing which can be installed on the water outlet of a sanitary outlet fitting in order to allow the water emerging there to flow out with an esthetically particularly attractive jet pattern. A jet former is provided on the outlet end side of the housing, which jet former has throughflow channels which are arranged on at least one annular or circular path on the outlet end side. The throughflow channels can be arranged on a circular path or, for example, also on an elliptical annular path on the outlet end side. These throughflow channels divide up the water flowing out of the jet former into separated, individual jets in such a manner that said outflowing water is formed from visibly separated individual jets.

A preferred embodiment according to the invention aims here for said individual jets to form, with their outflowing water, an interwoven outlet jet pattern. In addition or instead, said individual jets can also form an outlet jet pattern which tapers in certain regions and preferably tapers in a waist-shaped manner. For this purpose, the throughflow channels, which are arranged on at least one annular or circular path, in the jet former of the outlet unit according to the invention have a longitudinal channel axis which is inclined both in the direction of the longitudinal housing axis and in a circumferential direction. The outlet unit according to the invention is therefore distinguished by its esthetically particularly attractive outlet jet pattern.

Since the throughflow channels of the outlet unit according to the invention which is formed in accordance with the inventive proposal described above are arranged on at least one circular path, a particularly simple and preferred embodiment according to the invention makes provision for the housing of said outlet unit to have a round cross section.

In order to allow the individual jets forming the outlet jet pattern to emerge from the jet former in an arrangement appearing as homogeneous as possible, it is advantageous if all the throughflow channels have the same angle of inclination.

The outlet jet pattern of the outlet unit according to the invention is particularly appealing if the throughflow channels are inclined in the direction of the longitudinal housing axis such that the outflowing individual jets flowing out form, at a distance from the jet former, an annular zone which is smaller than the possibly outer circular path comprising throughflow channels.

A further inventive proposal for achieving the above object makes provision, in the case of the outlet unit of the type mentioned at the beginning, for the throughflow channels on the outlet end side of the housing to be arranged on at least two spaced-apart lines, and for the throughflow channels arranged on at least one line to have a longitudinal axis which is both inclined, in relation to the longitudinal housing axis, in the direction of the adjacent line of throughflow channels and is angled, in respect of the plane of the outlet end side of said The sanitary outlet unit, in relation to said outlet end side by an angle other than 90°. The outlet unit according to the invention configured in accordance with this inventive proposal has throughflow channels which are arranged on the outlet end side of the housing on at least two spaced-apart lines. Of said throughflow channels, at least the throughflow channels arranged on one of said lines have a longitudinal axis which in a is both inclined, in relation to the longitudinal housing axis, in the direction of the adjacent line of throughflow channels and is angled, in respect of the plane of the outlet end side of said The sanitary outlet unit, in relation to said outlet end side by an angle other than 90°. The throughflow channels arranged on at least one line therefore have angles other than 90° in relation to the axes of an X, Y and Z system of coordinates, wherein said throughflow channels are inclined in the direction of the throughflow channels arranged on the adjacent line. The individual jets flowing out of the throughflow channels appear to repeatedly intercept here along the line, and therefore a structure, which is woven in the manner of a grid or in the manner of a mesh, of said jets is visible in side view.

In order additionally to improve this esthetically attractive outlet jet pattern of the individual jets emerging along the line, it is advantageous if all the throughflow channels along the line have the same angle of inclination.

It is possible that, in an embodiment, the throughflow channels arranged on a line have a longitudinal axis running approximately axially parallel to the longitudinal axis of the housing while, by contrast, the throughflow channels arranged on at least one other line with respect to one another have a longitudinal axis which, by contrast, is angled. However, an embodiment is preferred in which the throughflow channels, which are arranged on lines assigned to one another in pairs, are arranged with point symmetry in relation to one another.

Although it is conceivable to arrange the throughflow channels, which are arranged on the outlet end side also of a circular housing, along a line in relation to one another, the arrangement of the throughflow channels along a line can be realized particularly advantageously if the housing has a rectangular cross section, and if the housing has narrow sides which are narrower in cross section than the longitudinal sides.

A structurally particularly simple embodiment according to the invention makes provision for the jet former to be designed in the form of a perforated plate.

It is advantageous here if the outlet end side forming the jet former is held immovably relative to the housing of the outlet unit, in particular in the circumferential direction. For this purpose, it is particularly advantageous if the perforated plate, which forms the outlet end side of the housing, is connected integrally to the housing.

In order to limit the water consumption in a simple manner, it can be advantageous if the jet former has arranged upstream of it, as seen in the flow direction, a flow restrictor, which narrows the clear throughflow cross section.

So that homogeneous and non-sputtering individual jets which form a likewise homogeneous outlet jet pattern can be formed in the jet former, it is advantageous if the jet former has arranged upstream of it, as seen in the flow direction, a jet divider, by which the water flowing through is divided up into a multiplicity of individual jets, and/or a throughflow-quantity regulator, by which the water flowing through is adjusted, and limited, to a maximum throughflow volume in a pressure-independent manner.

It is possible for the jet former of the outlet unit according to the invention to have arranged upstream of it just one jet divider and optionally an attachment screen or filter screen. In particular at high water pressures, which can lead to high energy and to powerful swirling of the emerging water, it is advantageous if the jet former has a flow restrictor or a throughflow-quantity regulator arranged upstream of it, as seen in the flow direction, and if a jet divider is provided between the throughflow-quantity regulator or the flow restrictor, on the one hand, and the jet former, on the other hand.

So that the comparatively delicate clear opening cross sections in the jet divider and in the jet former cannot be unintentionally closed by dirt particles entrained in the water, it is expedient if an attachment screen or filter screen is arranged upstream of the flow restrictor, the throughflow-quantity regulator and/or the jet divider, as seen in the flow direction.

The outlet unit according to the invention can be configured with a comparatively small axial longitudinal extent if the jet divider is designed in the form of a cup-like diffuser which, on the circumferential wall of its cup shape, has divider openings and a cup base of which serves as a baffle plate, by which the water flowing through is deflected to the divider openings.

It can be advantageous here if the divider openings open out in an annular gap which tapers in the throughflow direction. If this annular gap tapers in the throughflow direction, the water emerging from the divider openings in individual jets undergoes a substantial increase in speed which, in accordance with Bernoulli's equation, leads to negative pressure on the outflow side of the annular gap. With the aid of said negative pressure, when required and given an appropriate configuration of the outlet unit according to the invention, ambient air can also be sucked into the interior of the housing and is mixed there with the water flowing through.

In a refinement of the invention, it can be provided that the throughflow channels are designed to taper in the throughflow direction. It is therefore easily achievable for a desired outlet jet pattern to be maintained over a longer distance.

It is particularly favorable here if the throughflow channels each form a cone of which the center axis is inclined in relation to the longitudinal housing axis. A doubly inclined or tilted orientation of the outflow directions is therefore easily achievable. The outflow direction can be produced, for example, from an angle bisector of an opening cone.

Alternatively or additionally, it can be provided that an opening angle of the throughflow channels is selected to be of such a size that the throughflow channels are designed to be free of undercuts in relation to the longitudinal housing axis. It is of advantage here that simple demolding without multi-part molds is achievable.

BRIEF DESCRIPTION OF THE DRAWINGS

Developments according to the invention emerge from the description below in conjunction with the claims and the drawing. The invention is described in more detail below with reference to a preferred exemplary embodiment.

In the drawings:

FIG. 13 shows a perspectively illustrated outlet unit with a jet former which is provided on the outlet end side and has throughflow channels which are arranged on two spaced-apart lines, FIG. 14 shows the outlet unit from FIG. 13 with its outlet jet pattern, in a side view, FIG. 15 shows the outlet unit and the outlet jet pattern thereof in a side view rotated by 90° in relation to FIG. 14, FIG. 16 shows the outlet unit from FIG. 13 and the outlet jet pattern thereof in a perspectively illustrated side view.

DETAILED DESCRIPTION

Figure 1:
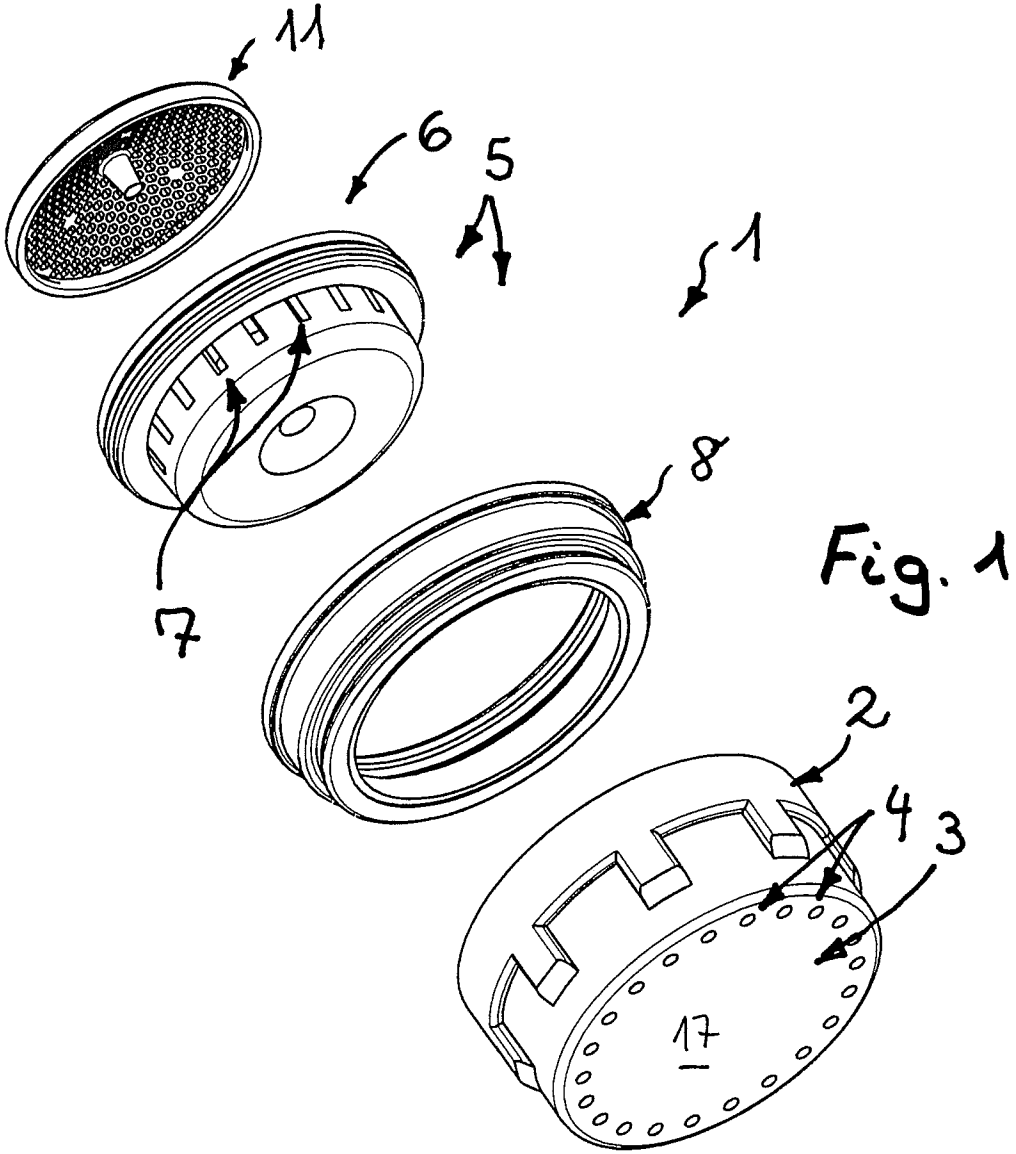
FIG. 1 shows a sanitary outlet unit in an exploded perspective illustration of its constituent parts, which has, inter alia, an outflow-side jet former which allows the water flowing through to emerge in an outlet jet pattern formed from individual jets flowing out in a visibly separated manner, wherein the outlet jet pattern is distinguished by an arrangement of the individual jets in interwoven form and tapering in certain regions.
Figure 4:
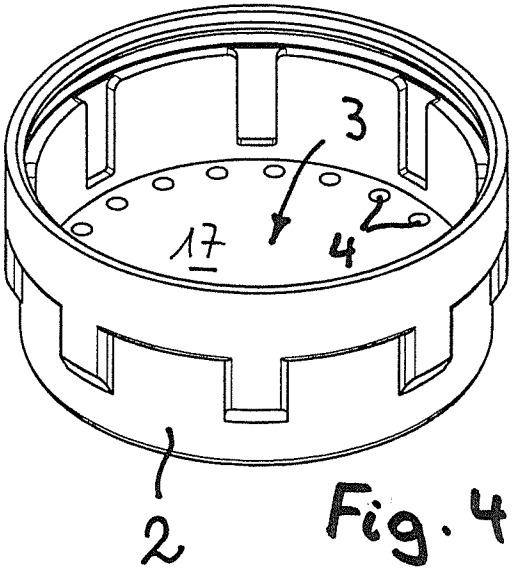
FIG. 4 shows the housing of the outlet unit as shown in FIGS. 1 to 3, the housing being illustrated in a perspective top view of its inflow side.
Figure 2:
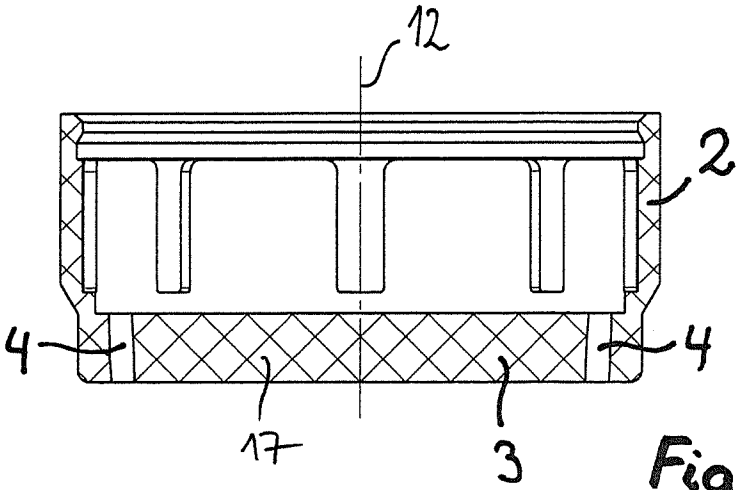
FIG. 2 shows the housing of the outlet unit, which is shown in FIG. 1, in a longitudinal section through the longitudinal axis of said outlet unit.
Figure 3:
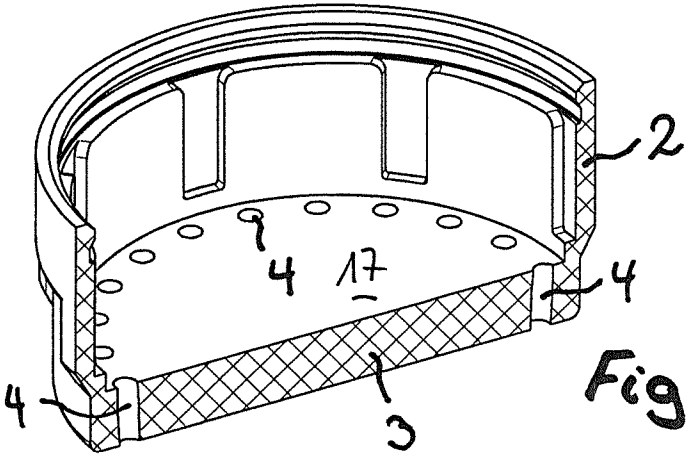
FIG. 3 shows the housing of the outlet unit, which is shown in FIGS. 1 and 2, in a perspective longitudinal section.

FIGS. 1 to 16 illustrate three embodiments 1, 10, 100 of a sanitary outlet unit. The sanitary outlet units 1, 10, 100 illustrated here have a housing 2 which can be installed on the water outlet of a sanitary outlet fitting (not illustrated further here). On its outlet end side, the housing 2 has a jet former 3, which has throughflow channels 4 which are arranged on the outlet end side of the outlet units 1, 10, 100. These throughflow channels 4 divide up the water flowing out of the jet former 3 into visibly separated individual jets.

While the throughflow channels 4 of the outlet units shown in FIGS. 1 to 12 are arranged on a circular path, the throughflow channels 4 of the outlet unit shown in FIGS. 13 to 16 are arranged on two spaced-apart lines L, L' which are preferably arranged parallel to each other.

Figure 8:
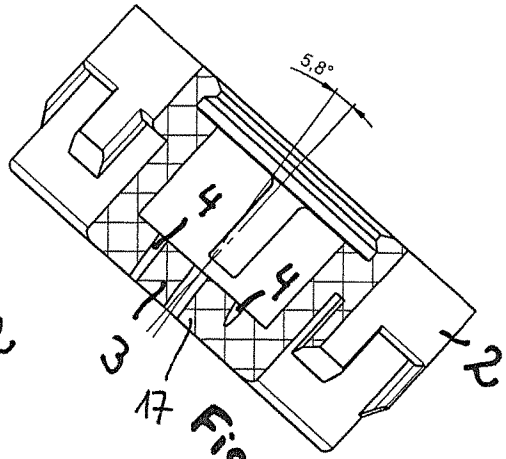
FIG. 8 shows the housing of the outlet unit as shown in FIGS. 1 to 7, said housing likewise only being slightly sectioned here in the section plane VIII-VIII as shown in FIG. 5.
Figure 9:
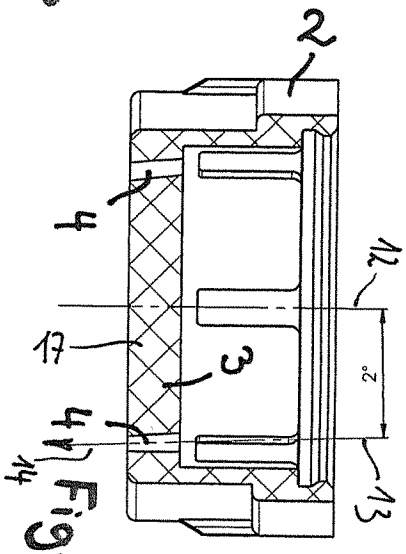
FIG. 9 shows the housing of the outlet unit, which is shown in FIGS. 1 to 8, the housing being sectioned in the section plane IX-IX as shown in FIG. 5.
Figure 7:
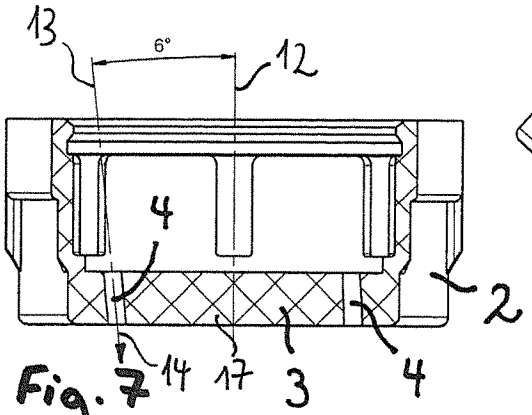
FIG. 7 shows the housing of the outlet unit, which is shown in FIGS. 1 to 6, the housing being sectioned in the section plane VII-VII as shown in FIG. 5.
Figure 5:
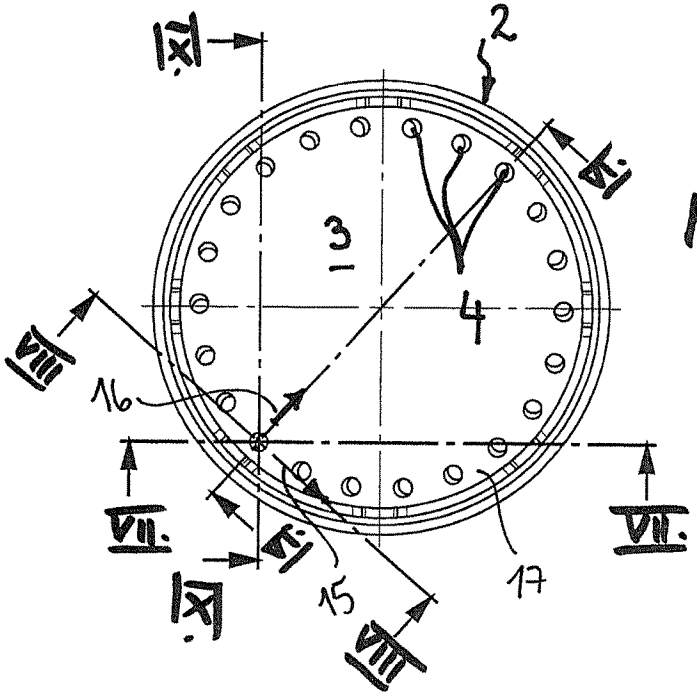
FIG. 5 shows the housing with the jet former integrally formed on the outflow side of the housing, in a top view of the inflow side of the housing.
Figure 6:
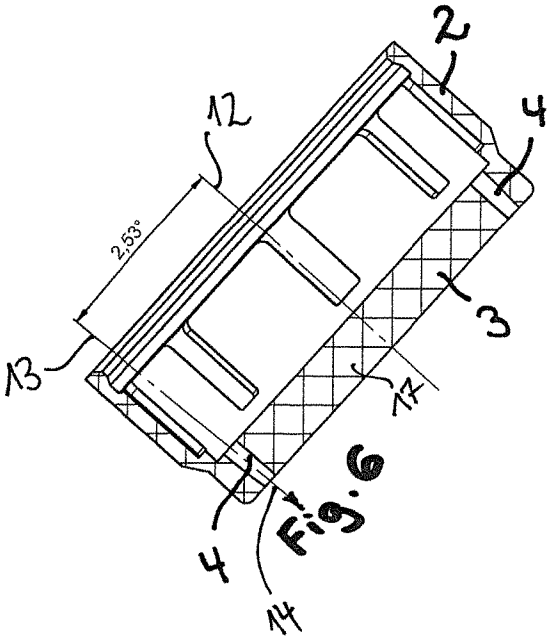
FIG. 6 shows the housing of the outlet unit, which is shown in FIGS. 1 to 5, in a longitudinal section through the section plane VI-VI in FIG. 5.

From an overall view in particular of FIGS. 5 to 9, it becomes clear that the throughflow channels of the outlet unit 1 have a longitudinal axis 13 which is inclined both in the longitudinal housing axis 12 (cf. FIG. 6) and in a circumferential direction (cf. FIGS. 7 to 9). All the throughflow channels 4 here have the same angle of inclination.

The jet former 3 of the outlet units 1, 10, 100 is designed here in the form of a perforated plate. While the throughflow channels 4 in the jet former 3 of the outlet units 1, 10 are arranged on at least one circular path, the throughflow channels 4 of the outlet unit 100 shown in FIGS. 13 to 16 are provided on at least two spaced-apart lines L, L'. This perforated plate forming the outlet end side of the housings 2 can also be connected integrally to the housing 2.

Figure 10:
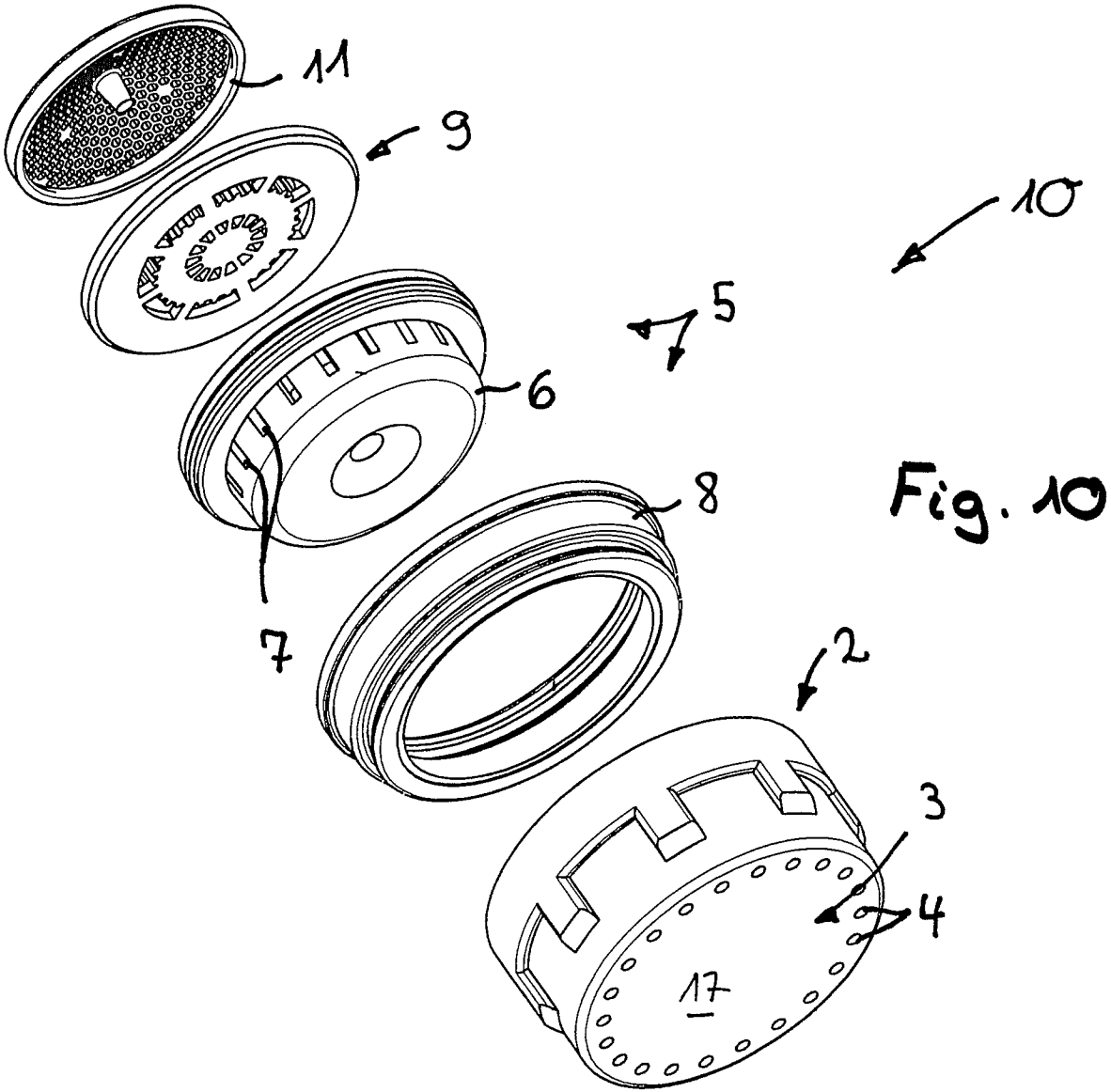
FIG. 10 shows an outlet unit, which is configured comparably to FIGS. 1 to 9, in an exploded perspective illustration, wherein a throughflow-quantity regulator is connected between the attachment screen and filter screen, which is arranged on the inflow side, on the one hand, and the jet divider, which is arranged downstream in the direction of flow, on the other hand, said throughflow-quantity regulator being intended to adjust the inflowing water to a maximum throughflow volume per unit of time independently of the pressure.

It can be seen in FIGS. 1 and 10 that the jet former 3 has arranged upstream of it a jet divider 5, by which the water flowing through is divided up into a multiplicity of individual jets. The jet divider 5 of the outlet units 1, 10 shown in FIGS. 1 and 10 is designed here in the form of a cup-like diffuser 6, which, on the circumferential wall of its cup shape, has divider openings 7 which are arranged at uniform distances in the circumferential direction. The cup base of the cup-like diffuser 6 is provided as a baffle plate 8, by means of which the water flowing through is deflected to the divider openings 7. The divider openings 7 open out on the outer circumference of the diffuser 6 in an annular gap which tapers in the throughflow direction. For this purpose, the diffuser 6 is engaged around by a diffuser ring 8, wherein the annular gap is arranged between the diffuser 6 and the diffuser ring 8.

The outlet unit shown in FIG. 10 additionally has a throughflow-quantity regulator 9 which adjusts the water flowing through to a maximum throughflow volume in a pressure-independent manner. This throughflow-quantity regulator 9 is arranged upstream of the jet divider 5, as seen in the flow direction. Instead of the throughflow-quantity regulator 9, use can also be made here of a flow restrictor (not shown further here) which narrows the throughflow cross section in this region and likewise reduces the water consumption.

From a comparison of FIGS. 1 and 10, it becomes clear that an attachment screen or filter screen 11 is arranged upstream of the jet divider 5 and optionally also the throughflow-quantity regulator 9 of the outlet units 1, 10, as seen in the flow direction, and is intended to retain and filter out the limescale and dirt particles which are entrained in the water and which could otherwise impair the function of the following constituent parts of the outlet units 1, 10 and in particular of the jet divider 5, the throughflow-quantity regulator 9 and the jet former 3.

From an overall view of FIGS. 5 to 9, it can be seen that the throughflow channels 4 are inclined in the direction of the longitudinal housing axis 12 such that the outflowing individual jets form, at a distance from the jet former and preferably before arriving in a water basin, an annular zone which is smaller than the possibly outer circular path comprising the throughflow channels 4 of the jet former 3.

Figure 12:
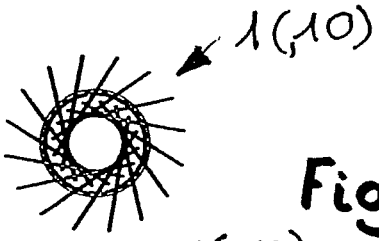
FIG. 12 shows the outlet jet pattern of the outlet units, which are shown in FIGS. 1 to 10, in a top view of the outlet end side of said outlet units.
Figure 11:
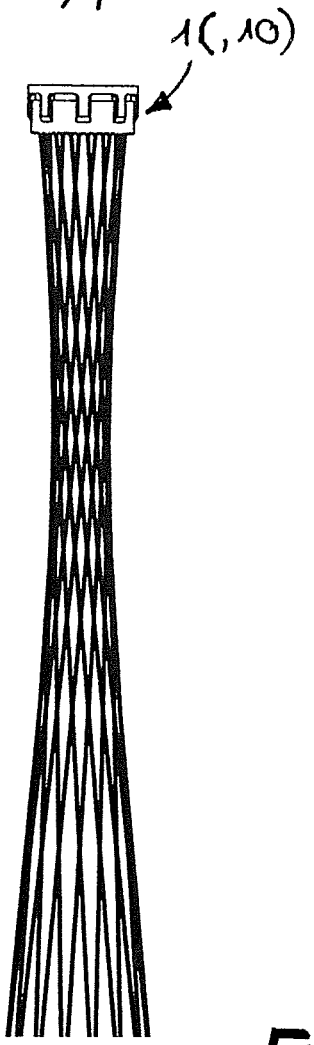
FIG. 11 shows the outlet jet pattern of the outlet units, which are shown in FIGS. 1 to 10, in a side view.
Figure 17:
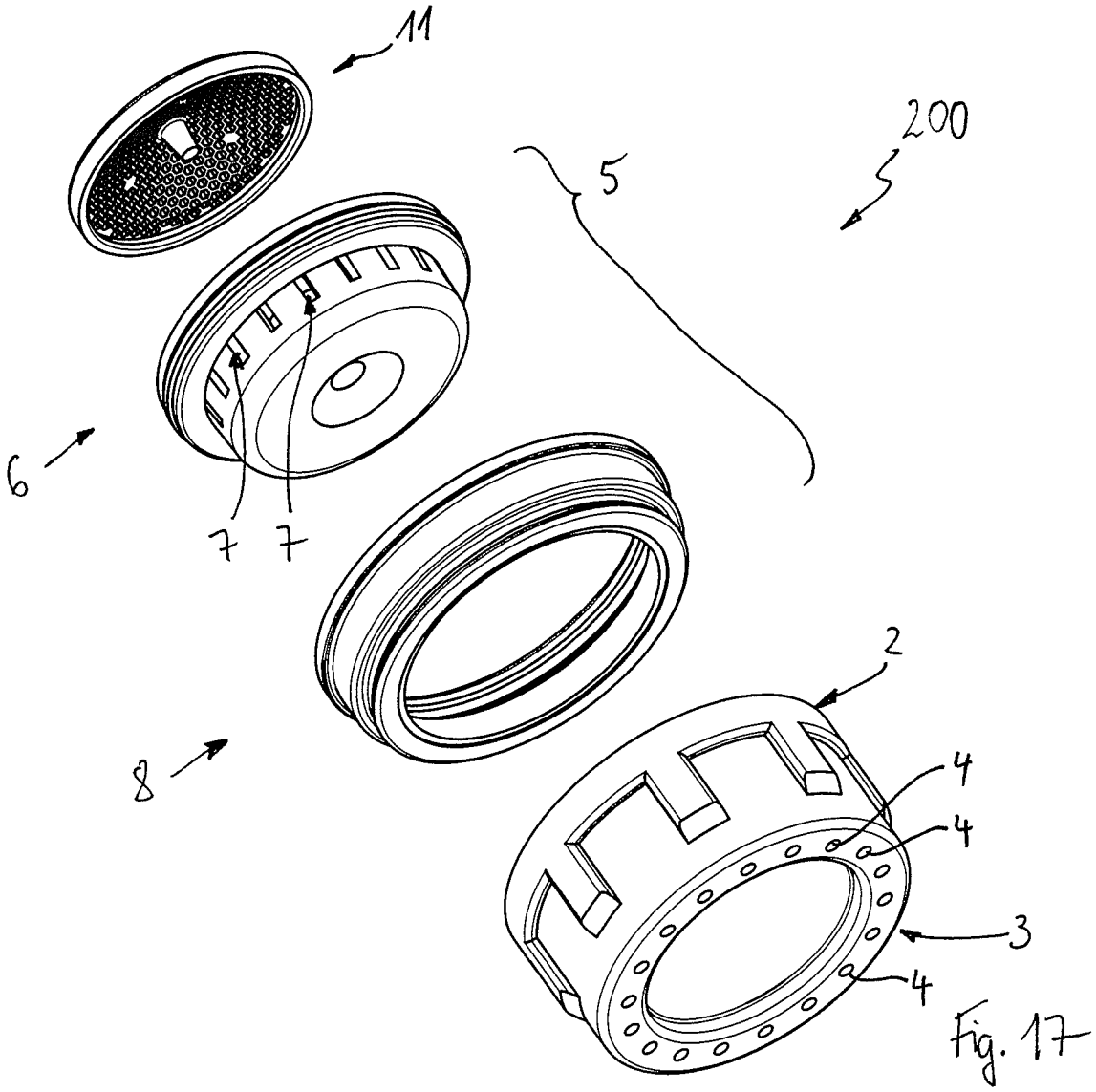
FIG. 17 shows a further sanitary outlet unit as shown in the invention with conical throughflow channels, in an exploded perspective illustration of its constituent parts.
Figure 20:
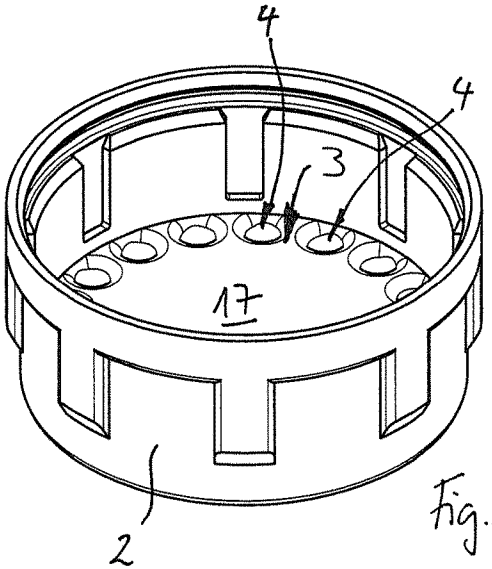
FIG. 20 shows the housing of the outlet unit as shown in FIGS. 17 to 19, the housing being illustrated in a perspective top view of its inflow side.
Figure 18:
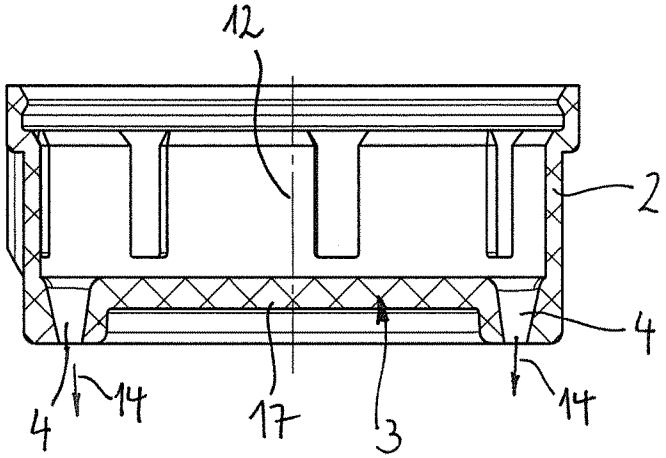
FIG. 18 shows the housing of the outlet unit, which is shown in FIG. 17, in a longitudinal section through the longitudinal axis of said outlet unit.
Figure 19:
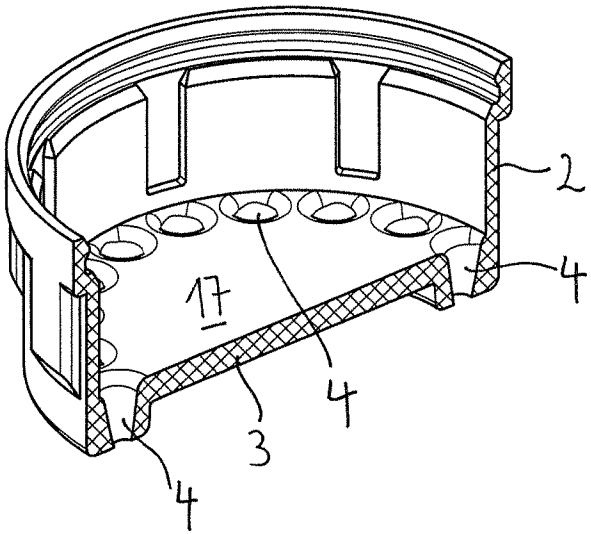
FIG. 19 shows the housing of the outlet unit, which is shown in FIGS. 17 and 18, in a perspective longitudinal section.
Figure 24:
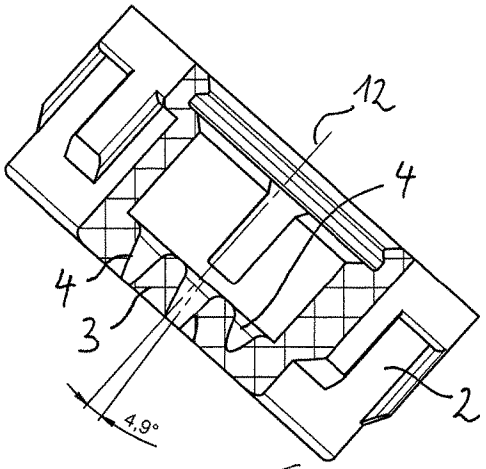
FIG. 24 shows the housing of the outlet unit as shown in FIGS. 17 to 23, said housing likewise only being slightly sectioned here in the section plane C-C as shown in FIG. 21.
Figure 25:
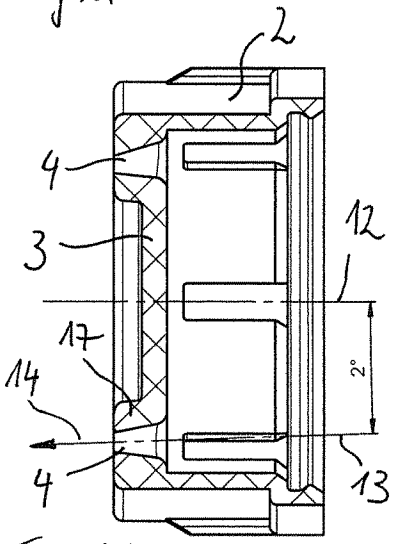
FIG. 25 shows the housing of the outlet unit shown in FIGS. 17 to 24, said housing being sectioned in the section plane D-D as shown in FIG. 21.
Figure 23:
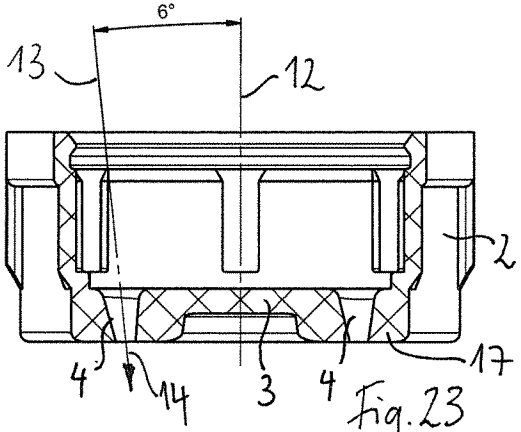
FIG. 23 shows the housing of the outlet unit, which is shown in FIGS. 17 to 22, the housing being sectioned in the section plane B-B as shown in FIG. 21.
Figure 21:
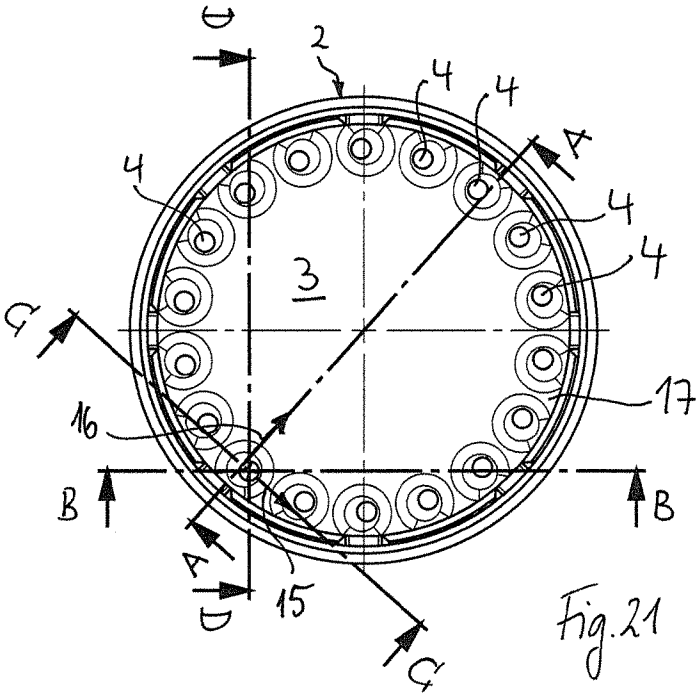
FIG. 21 shows the housing as shown in FIGS. 17 to 20 with the jet former, which is integrally formed on the outflow side of the housing, in a top view of the inflow side of the housing.

FIGS. 11 and 12 show the outlet jet pattern formed by the individual jets flowing out of the outlet units 1, 10. As FIGS. 11 and 12 show, said individual jets form an interwoven outlet jet pattern which tapers in certain regions and is esthetically particularly attractive.

The outlet unit 100 shown in FIGS. 13 to 16 has a jet former 3 with throughflow channels which are arranged on spaced-apart lines L, L' which are preferably arranged parallel to each other. The throughflow channels 4 which are arranged on at least one line and are provided here on both lines L, L' each have a longitudinal axis 13 which in a is both inclined, in relation to the longitudinal housing axis 12 in the direction of the adjacent line of throughflow channels 4 and is angled, in respect of the plane of the outlet end side of said The sanitary outlet unit, in relation to said outlet end side by an angle other than 90°. All the throughflow channels here along the line have the same angles of inclination, wherein the throughflow channels 4, which are arranged on the lines L, L' assigned to one another in pairs, are arranged with point symmetry in relation to one another. It can be seen from FIGS. 14 to 16 that the individual jets emerging from the jet former 3 of the outlet unit 100 here form an outlet jet pattern which is seemingly curved in an interwoven or mesh-like manner in side view, wherein the section plane of the individual jets intersecting one another along a line is intended to be arranged at a distance above a wash basin or collecting basin. The outlet unit 100 shown in FIGS. 13 to 16 is also distinguished by an esthetically particularly attractive outlet jet pattern.

FIGS. 17 to 25 show a further exemplary embodiment according to the invention of a sanitary outlet unit. Components and functional units which are identical or similar in terms of function and/or structure to the preceding exemplary embodiments are denoted here with the same reference signs and are not described separately again. The statements regarding FIGS. 1 to 16 therefore apply correspondingly to FIGS. 17 to 25.

Figure 22:
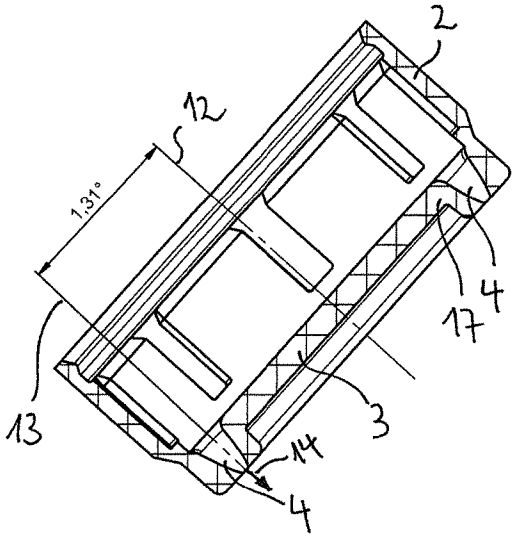
FIG. 22 shows the housing of the outlet unit, which is shown in FIGS. 17 to 21, in a longitudinal section through the section plane A-A in FIG. 21.

The exemplary embodiment as shown in FIGS. 17 to 25 differs from the preceding exemplary embodiments at least in that the throughflow channels 4 are not formed cylindrically, but rather in a conically tapering manner. FIGS. 18 to 25 in particular show here that the cones are each positioned obliquely with respect to the longitudinal housing axis 12. The section C-C is positioned parallel to the tangential direction 15 in a throughflow channel 4 against the closed path which connects all of the throughflow channels 4 and runs in a circular manner here. FIG. 22 accordingly shows a section which runs in a plane which is defined by the longitudinal housing axis 12 and the tangential direction 15. It can be seen that the outflow direction 14, which is provided by the orientation of the throughflow channel 4 and in particular the longitudinal axis 13 thereof, is rotated in said plane in relation to the longitudinal housing axis 12 and therefore takes up an angle with the longitudinal housing axis 12. The section A-A is positioned along a complementary direction 16, which is perpendicular to the tangential direction 15, and therefore runs in a plane which is defined by the longitudinal housing axis 12 and the complementary direction 16. It can therefore be seen in FIG. 23 that the outflow direction 14 is also rotated counter to the longitudinal housing axis 12 in this plane and therefore is at an angle to the longitudinal housing axis 12.

The described inclinations of the longitudinal channel axes 13 are formed here by the fact that the cones of the throughflow channels 4 each have geometrical center axes which are tilted in relation to the longitudinal housing axis 12 in the two planes mentioned.

The opening angles of the individual cones are selected here to be of such a size that no undercuts are formed along the longitudinal housing axis 12 from the inflow side. It is therefore possible for demolding of a mold to take place in a simple manner.

Figure 26:
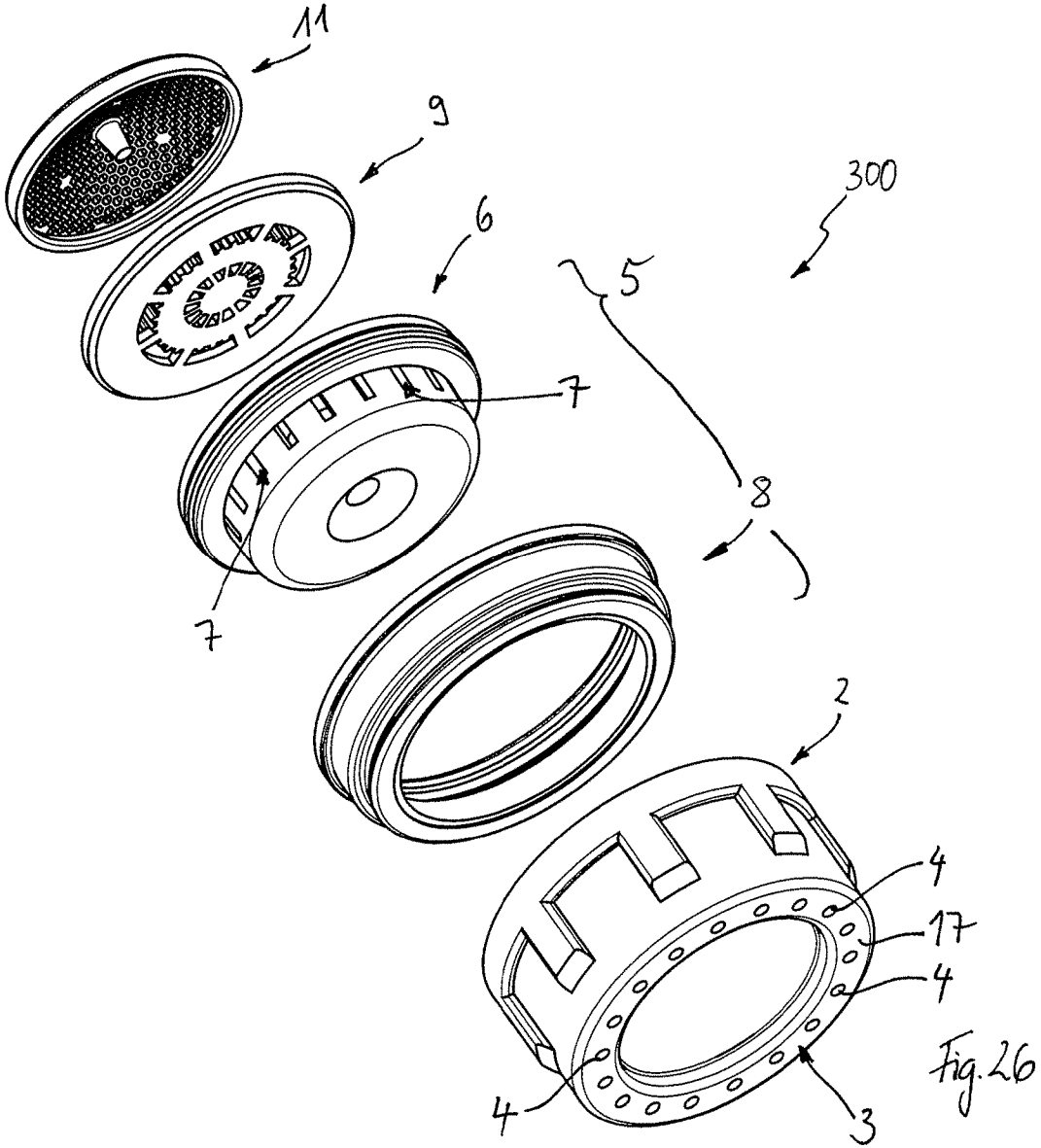
FIG. 26 shows an outlet unit, which is configured comparably to FIGS. 17 to 25, in an exploded perspective illustration, wherein a throughflow-quantity regulator is connected between the attachment screen and filter screen, which is arranged on the inflow side, on the one hand, and the jet divider, which is arranged downstream in the direction of flow, on the other hand, said throughflow-quantity regulator being intended to adjust the inflowing water to a maximum throughflow volume per unit of time independently of the pressure.

FIG. 26 shows a modification of the exemplary embodiment as shown in FIGS. 17 to 25, in which use is additionally made of a throughflow-quantity regulator 9.

The angle details apparent in the figures serve merely for illustrating the preferred exemplary embodiments and may be realized differently in further exemplary embodiments.

In the case of a sanitary outlet unit, it is therefore proposed to form throughflow channels 4 in a jet former 3 in such a manner that an outflow direction 14 predetermined by each throughflow channel 4 is oriented in a manner tilted in relation to a longitudinal housing axis 12 in two planes perpendicular to each other and/or about two directions perpendicular to each other.

LIST OF REFERENCE SIGNS

1 outlet unit (as shown in FIGS. 1 to 9)
2 housing
3 jet former
4 throughflow channels
5 jet divider
6 diffuser
7 divider openings
8 diffuser ring
9 throughflow-quantity regulator
10 outlet unit (as shown in FIG. 10)
11 attachment screen or filter screen
12 longitudinal housing axis
13 longitudinal channel axis
14 outflow direction
15 tangential direction
16 complementary direction
17 perforated plate
100 outlet unit (as shown in FIGS. 13 to 16)
200 outlet unit (as shown in FIGS. 17 to 25)
300 outlet unit (as shown in FIG. 26)
L line
L' line

The invention claimed is:

1. A sanitary outlet unit fitting having an outlet, wherein the fitting comprises a spray jet regulator (1, 10) installed thereon, the spray jet regulator comprising:

a housing (2) which is installable in the water outlet of the sanitary outlet fitting, a jet divider (5) having a cup-shaped diffuser (6) comprising divider openings (7) in a circumferential wall thereof and a baffle plate, by which water flowing through is deflected to the divider openings (7), the divider openings (7) open out from outer circumference of the diffuser (6) into an annular gap, which tapers in a flow direction, wherein water emerging from the divider openings (7) in individual jets undergoes an increase in speed which, creates negative pressure on an outflow side of the annular gap, a jet former (3), downstream of the jet divider (5), which has throughflow channels (4) arranged in an outlet end side of the housing (2), the throughflow channels (4) divide the water flowing from the annular gap and out of the jet former (3) into separated, individual jets, the throughflow channels (4) are arranged about an inner circumference of the jet former in at least one closed path, each throughflow channel (4) defining an outflow path (14), each outflow path (14) extending:

(a) at a first angle from an axial direction in a plane defined by a central longitudinal housing axis (12);

(b) at a second angle to a tangential direction (15) that is tangential to the at least one closed path, the second angle is located in a same quadrant for each of the throughflow channels (4); and (c) at a third angle to the longitudinal axis in a plane defined by the longitudinal housing axis (12) and a complementary direction (16), which is perpendicular to the central longitudinal housing axis (12) and the tangential direction (15), and wherein all of the outflowing individual jets, at a closest point to one another, are radially spaced apart from the longitudinal center axis (12) defining an open center space where no individual jet intercepts the longitudinal center axis (12), and wherein outflowing water from the individual jets flowing out of the spray jet regulator (1, 10) form at least one of an interwoven outlet jet pattern or an outlet jet pattern which tapers in certain regions the pattern having rows of diamond shapes in the flow direction when viewed from a side.

2. The sanitary outlet fitting as claimed in claim 1, wherein the outflow paths (14) of the spray jet regulator (1, 10) are defined by a longitudinal axis (13) of the respective throughflow channel (4).

3. The sanitary outlet fitting as claimed in claim 1, wherein the outflow paths (14) of the spray jet regulator (1, 10) are inclined into an inner space relative to the closed path.

4. The sanitary outlet fitting as claimed in claim 1, wherein the closed path is an annular or circular path, or the complementary direction (16) is a radial direction.

5. The sanitary outlet fitting as claimed in claim 1, wherein the throughflow channels (4) of the spray regulator (1, 10) each have a longitudinal axis (13) which is inclined both in the direction of the longitudinal housing axis (12) and in a circumferential direction.

6. The sanitary outlet fitting as claimed in claim 1, wherein the housing (2) of the spray regulator (1, 10) has a round cross section.

7. The sanitary outlet fitting as claimed in claim 1, wherein all of the throughflow channels (4) of the spray regulator (1, 10) have a same angle of inclination relative to their positions around the circumference of the jet former.

8. The sanitary outlet fitting as claimed in claim 7, wherein the throughflow channels (4) of the spray regulator (1, 10) are inclined in a direction of the longitudinal housing axis (12) such that the outflowing individual jets form, at a distance from the jet former (3), an annular zone which is smaller than the closed path formed as an outer circular path comprising the throughflow channels (4).

* * * * *